US006439564B2

(12) United States Patent
Andersson et al.

(10) Patent No.: US 6,439,564 B2
(45) Date of Patent: Aug. 27, 2002

(54) DOCUMENT DISPENSING APPARATUS

(75) Inventors: Jorgen Andersson, Valla; Teru Horpu, Sholdinge; Anders Nordin, Flen, all of (SE)

(73) Assignee: De la Rue Cash Systems AB, Flen (SE)

( * ) Notice: Subject to any disclaimer, the term of this patent is extended or adjusted under 35 U.S.C. 154(b) by 0 days.

(21) Appl. No.: 09/789,747

(22) Filed: Feb. 22, 2001

(30) Foreign Application Priority Data

Feb. 22, 2000 (GB) ..... 0004204
Sep. 12, 2000 (SE) ..... 0003241

(51) Int. Cl.[7] ..... B65H 5/00

(52) U.S. Cl. ..... 271/10.03; 271/10.1; 271/10.13; 271/122; 271/126; 271/110

(58) Field of Search ..... 271/10.03, 10.1, 271/10.13, 122, 116, 126, 110

(56) References Cited

U.S. PATENT DOCUMENTS 3,961,786 A 6/1976 Yanker
4,368,881 A 1/1983 Landa
4,869,490 A 9/1989 Reid
5,029,837 A * 7/1991 Uchiyama ..... 271/110
5,039,080 A * 8/1991 Katol et al. ..... 271/122
5,580,040 A * 12/1996 Atsutri et al. ..... 271/121
5,651,542 A * 7/1997 Yamauchi et al. ..... 271/122

FOREIGN PATENT DOCUMENTS

EP 0 393 589 A1 10/1990
JP A 58-11437 1/1983
WO WO 98/23513 6/1998

* cited by examiner

*Primary Examiner*—H. Grant Skaggs
(74) *Attorney, Agent, or Firm*—Oliff & Berridge, PLC

(57) ABSTRACT

An arrangement for feeding documents piecemeal from a document bundle (9) comprises a banknote separator (200) which includes two mutually biased rollers (4,6) that are driven by a drive motor (1) that also drives a dispensing roller (3) which functions to dispense documents from the bundle. The rollers (4,6) of the roll pair are rotationally coupled together via a freewheeling hub. The second roller (6) does not rotate during dispensing of a document. Upon completion of a dispensing operation, the drive direction of the motor (1) is reversed, so as to bring the second roller (6) to a new angular position.

14 Claims, 5 Drawing Sheets

DOCUMENT DISPENSING APPARATUS

FIELD OF THE INVENTION

The present invention relates to apparatus for dispensing documents such as banknotes or other documents of value piecemeal from a bundle of documents.

DESCRIPTION OF THE PRIOR ART

Known such apparatus comprises a bundle holder that includes a slide surface on which the bundle rests and is displaced forwards, a front wall, a pusher which pushes the bundle along the slide surface and into contact with the front wall, a dispensing roll of which a peripheral part is in contact with the foremost document in the bundle, drive means for selective rotation of the dispensing roll in a first direction, for dispensing said foremost document in the bundle in the plane of said document, a pair of rolls that have mutually parallel axles and that are adapted so that their barrel surfaces act on respective opposite sides of a document dispensed into the nip defined by said roll pair, wherein the rolls of said roll pair are rotated at different peripheral speeds so as to mutually separate any documents that may have been dispensed essentially simultaneously by the dispensing roll, a conveyor that receives documents passing through the roll pair and conveys said documents at a speed which is higher than the speed at which the documents pass through the roll pair, and a sensor that detects the arrival of the document in the conveyor.

One problem with arrangements of this kind is that the document separator is expensive, complex and wears relatively quickly. Known separators normally include a roll pair of which one roll is driven to drive the document into the conveyor, whereas the other roll is driven to provide a braking force of selected magnitude on a document advanced by the roll pair.

SUMMARY OF THE INVENTION

In accordance with the present invention, document dispensing apparatus comprises a document store having a document exit; a feed roller for feeding documents out of the document store through the document exit; and a separation system including a pair of juxtaposed rollers defining a nip to which documents are fed from the document store exit, and a drive motor coupled to one of the rollers to cause the one roller to rotate in a document feed direction, the one roller being drivingly coupled to the other roller of the pair via a one-way transmission such that drive is communicated to the other roller only when the one roller is driven in a direction opposite to the feed direction.

With this invention, the separation system has a much simpler construction than the prior art and is highly reliable while achieving even wear on the "other" roller.

Preferably, the coefficient friction of the one roller is higher than that of the other roller. This enhances the separation process carried out by the separation system.

Conveniently, the apparatus further comprises a conveyor which receives a document passing between the pair of rollers, and which conveys the document at an elevated speed; a sensor for detecting the presence of a document at the inlet to the conveyor; and a control unit, the sensor being adapted to cause the control unit to influence the current supply to the drive motor when detecting the leading edge of said document, so as to reduce braking of a document passing through the roller pair and having entered the conveyor, to a selected level.

In the preferred arrangement, the drive motor may also be adapted to drive the feed roller. When the sensor detects that a document has been fed into the conveyor, it causes a computer connected thereto to change the supply of current to the motor so as to reduce the braking effect of the roller pair on the document. The conveyor engages a document before the document has left the roller nip, whereby the document is braked by virtue of the conveyor speed being greater than the conveying speed of the roller pair. When the sensor later detects the trailing edge of the document, the computer is caused to drive the motor in the reverse direction for a short period of time, for instance for some milliseconds. The second transmission then jogs the second roller of said roller pair into rotation, preferably in a direction which is opposite to the direction in which the document passes through the roller nip. Consequently, after each separation operation, the second roller of the roller pair will rotate to advance a fresh peripheral section for coaction with a document and the barrel surface of the first roller of said roller pair respectively.

The transmission between the first and second rollers of the roller pair may include mutually coacting gearwheels disposed coaxial with the rollers of said roller pairs or alternatively a drive belt and one-way clutch could be used. The second roller of the roller pair is preferably suitably spring-biased in a direction towards the first roller of the roller pair. For example, the second roller of said roller pair may have a central shaft shank that is guided in chassis slots for movements in a normal direction to the documents passing through the roller pair.

BRIEF DESCRIPTION OF THE DRAWINGS

An example of banknote dispensing apparatus according to the present invention will now be described with reference to the accompanying drawings, in which:-

DESCRIPTION OF THE EMBODIMENT

Figure 1A:
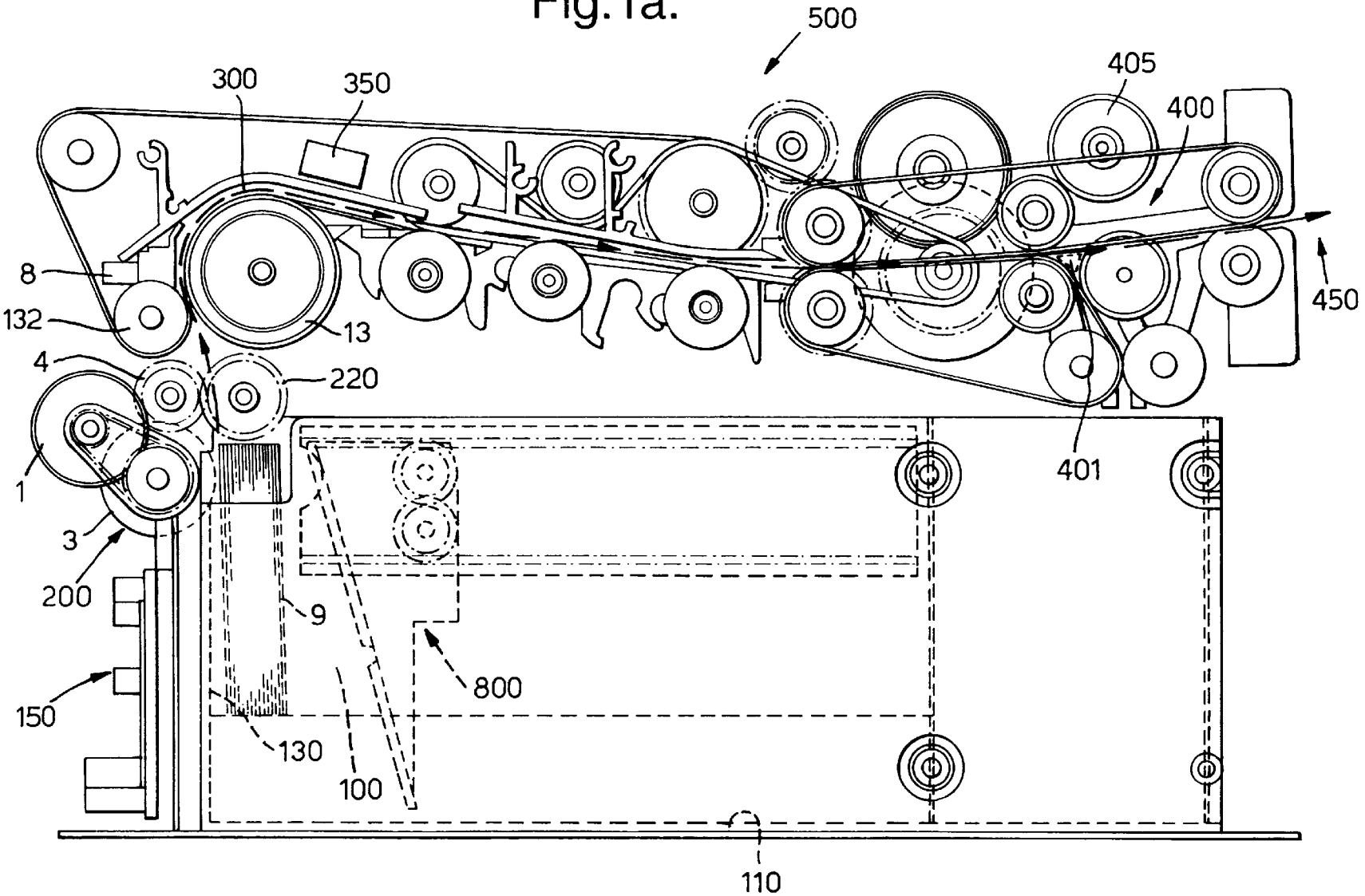
FIGS. 1*a* and 1*b* are side views of the apparatus in two different configurations.

As is shown in the drawings, a note and media dispensing apparatus 500 has a note compartment 100 defined by a base 110, side walls 120 and a front wall 130, in which notes 9 are pushed by a spring loaded device 800 against pick rollers 3 of a note feeding and separating mechanism 200. The note compartment 100 has known adjustable features, which are set to suit the chosen note size. Notes are fed one by one and separated by the note feed and separating mechanism 200 and fed into a note transport path 300.

Figure 2A:
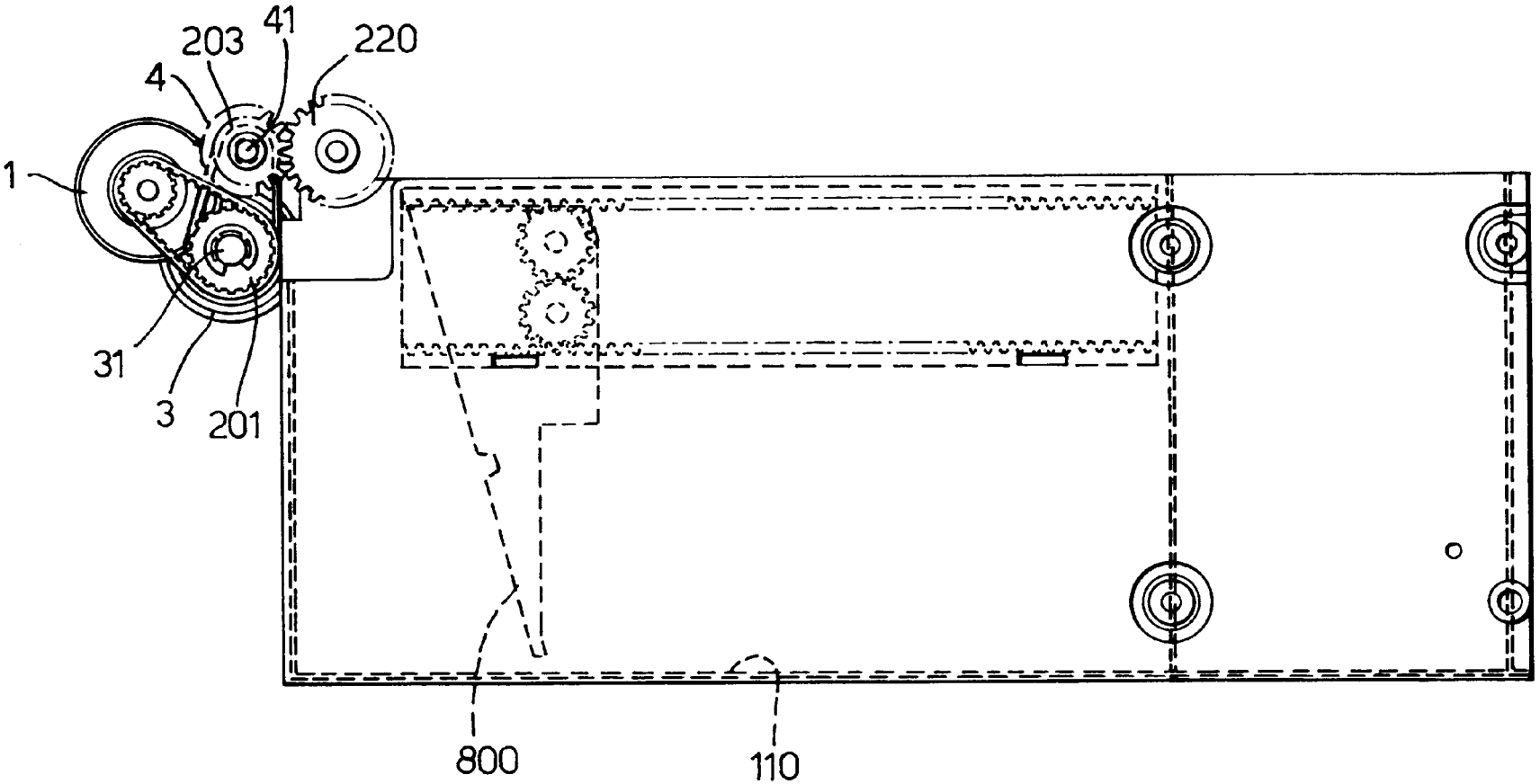
FIGS. 2*a* and 2*b* are a side elevation of part of the apparatus shown in FIG. 1 illustrating the drive components and a perspective view of the apparatus respectively.

The note feed and separating mechanism 200, FIG. 2*a*, consists of two pick rollers 3 arranged non-rotatably on a common shaft 31 to which a toothed pulley 201 is non-rotatably mounted, pulley 201 being connected by a toothed belt 202 to a toothed pulley 203 non-rotatably mounted to a shaft 41 to which a feed roller 4 is non-rotatably mounted. Toothed pulley 204 is also connected via a toothed belt 205 and pulley 206 to the drive shaft of a motor 1.

Shaft 31 and 41 are rotatably mounted at each end to side members (not shown for clarity) of the body of the equipment.

Figure 2B:
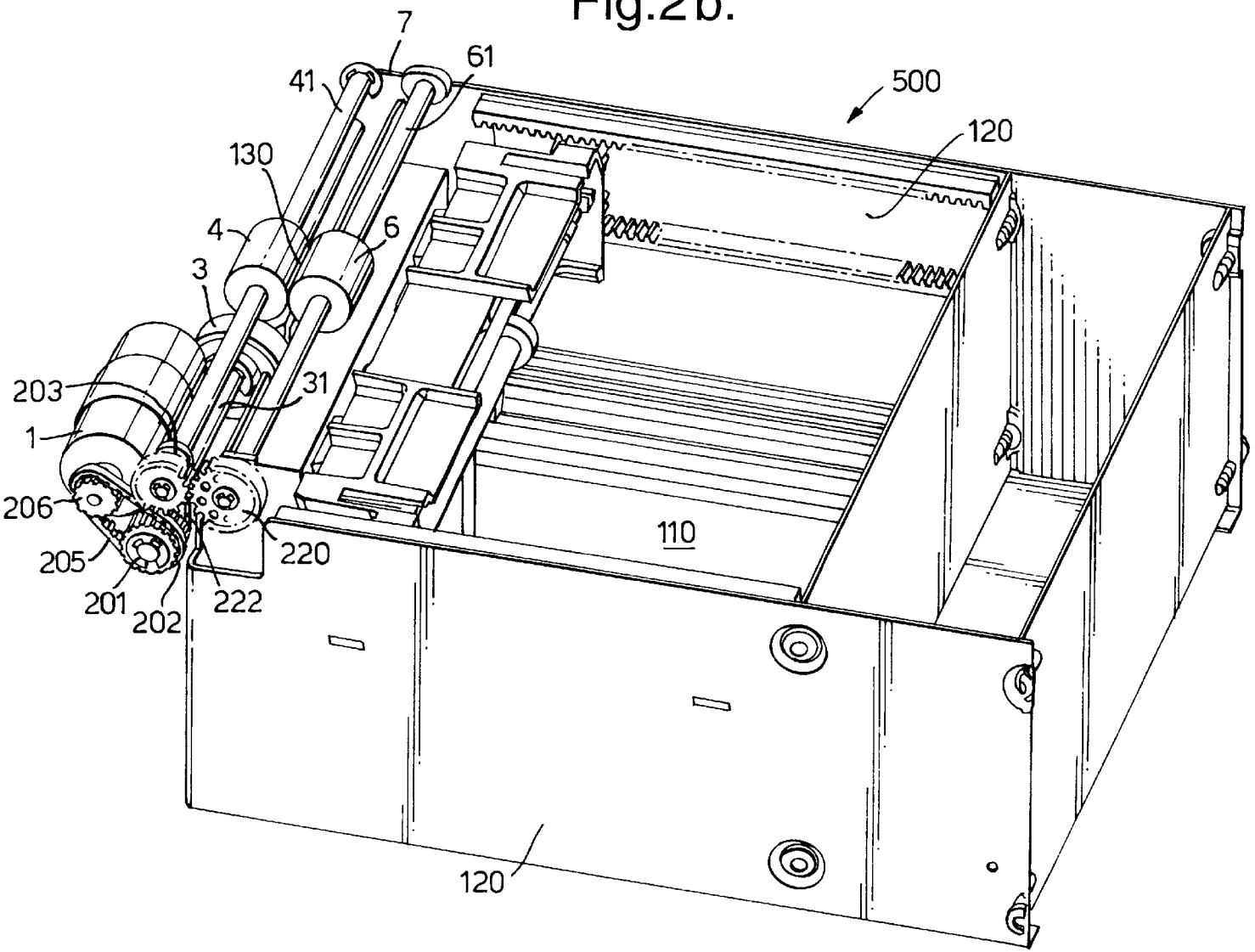
Figure 2C:
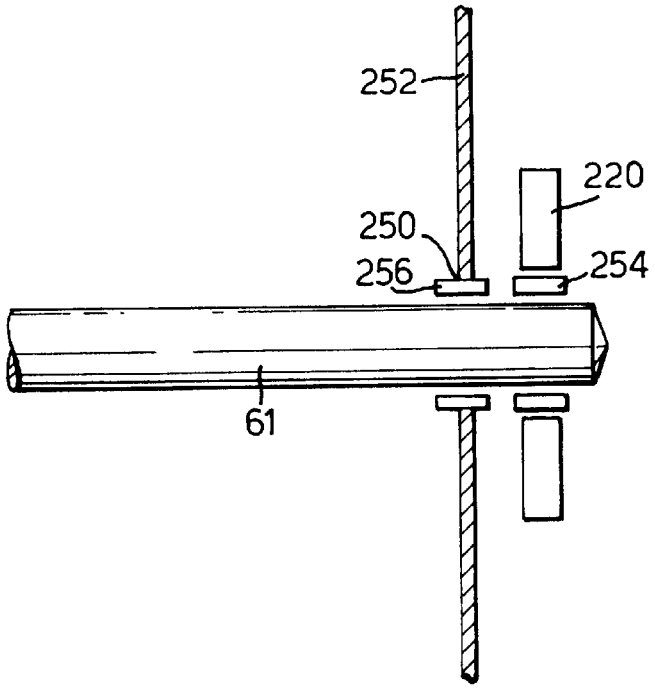
FIG. 2*c* is a cross-section through part of the separator system.

Transversely aligned with, and making contact with the feed roller 4, is the note separation mechanism which comprises of a separation roller 6 non-rotatably mounted on a shaft 61 mounted at each end within slots 250 in the side members 252 (only one shown in FIG. 2*c* for clarity) of the body of the equipment. A toothed pulley 220, one-way rotatably mounted via a clutch 254 on shaft 61 where it extends outside of the side members 252 of the equipment, is connected to a toothed pulley 222 non-rotatably mounted to the shaft 41. The shaft 61 is coupled to one of the side members 252 by a one-way clutch 256. The connections of the shaft 61 and the pulley 220 to one-way clutches 254,256 are such that when a note is driven through the nip 130 by the roller 4, the shaft 61 is locked to the side member 252 by clutch 256 while when the pulley 222 is rotated opposite to the feed direction drive is coupled to the shaft 61 via the pulley 220 by the clutch 254 so that the shaft 61 is rotated anti-clockwise (FIG. 2*b*).

A shaped wire spring 7 ensures the separator roller 6 is always biased towards making contact with either the roller 4 or the note(s) being transported in the nip 130 between the rollers 4,6. Upstream of the rollers 4,6 are transport rollers 13 (FIG. 1*a*) for onwardly transporting the notes fed by the feed and separator mechanisms.

A sensor 8 (FIG. 1*a*) is positioned to detect the note entering and leaving a nip 132 between the transport rollers 13, information which is then used for the pick/separator sequence control.

A motor controller (not shown) provides the control/drive for the feed mechanism motor 1. The controller is operated on instructions provided by a central processing unit 150.

In a typical operating sequence to feed notes from the stack of notes 9, one at a time, into the transport arrangement represented by the rollers 13, a command is sent to the motor controller from the central processing unit to feed a document. The motor 1 is thereby activated to rotate the pick rollers 3 anticlockwise to advance the first document 9 towards the rollers 4,6, the feed roller 4 being rotated anticlockwise to further advance the document towards the pair of transport rollers 13. Because of separation roller 6, which is blocked from rotation clockwise by means of the one-way clutch 254, the pick force applied to the document from the pick roller 3 and feed roller 4, must be greater than the force applied to the document from the separation roller 6. This is achieved by using different friction coefficients on rollers 4 and 6.

Figure 1B:
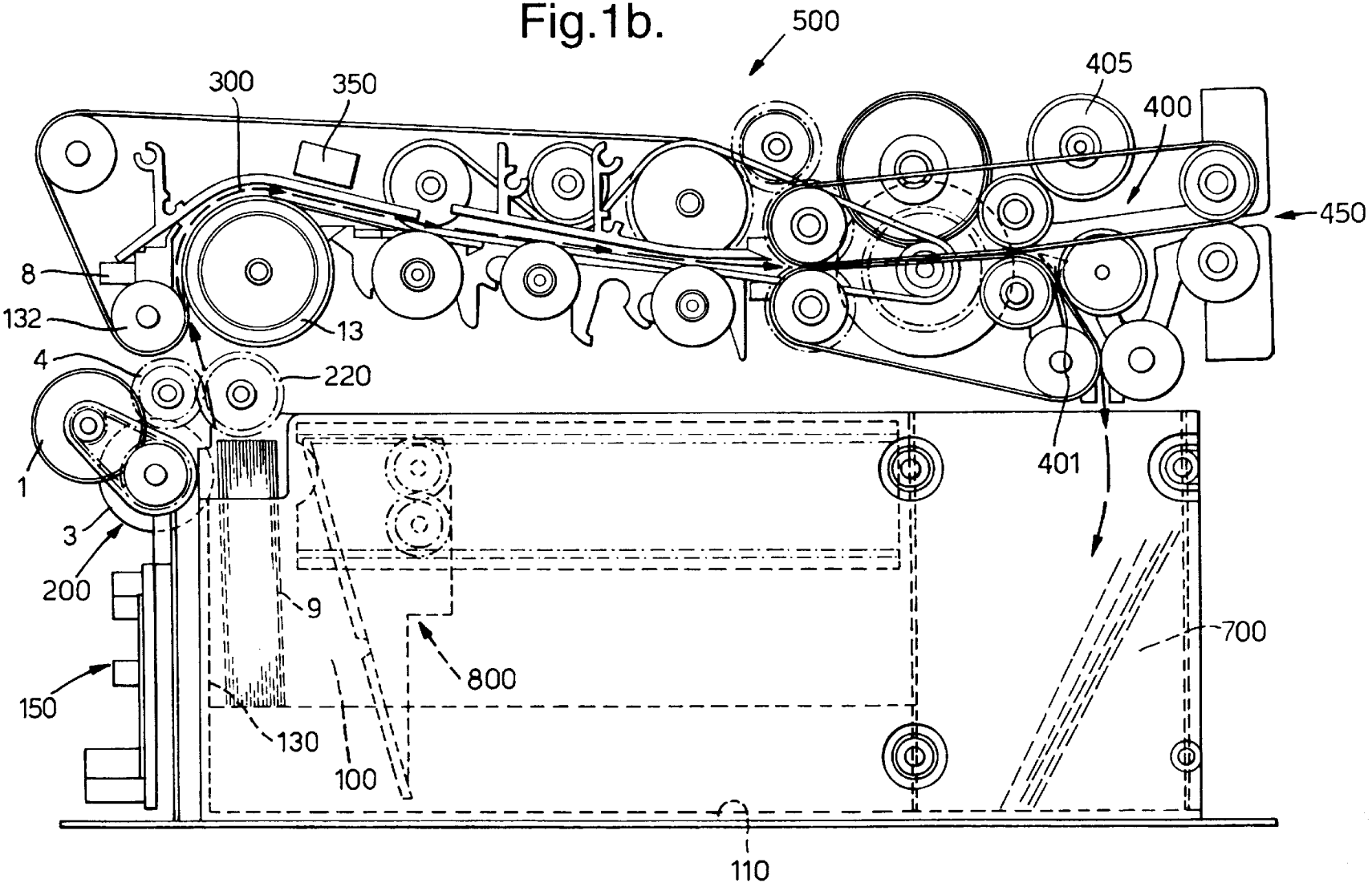

When the leading edge of the document is detected by the sensor 8, the motor 1 is switched to run with different (lower) current to follow and the document is pulled out from the mechanism by the pair of rollers 13. When sensor 8 detects the trailing edge of the document, the motor 1 is switched to run such that the pulley 203 rotates clockwise (as seen in FIGS. 1*a*,1*b*) and thus the pulley 220 and hence the shaft 61 are rotated anticlockwise by engagement of the one-way clutch for "X" ms and is switched off.

A note fed in the manner described above is transported along the transport path 300 of known construction, comprising of belts and rollers or combinations of such means, passed a multiple note detector 350 in FIG. 1, which checks that it is only a single note passing through the detector and also determines the level of skew of the note.

Figure 3:
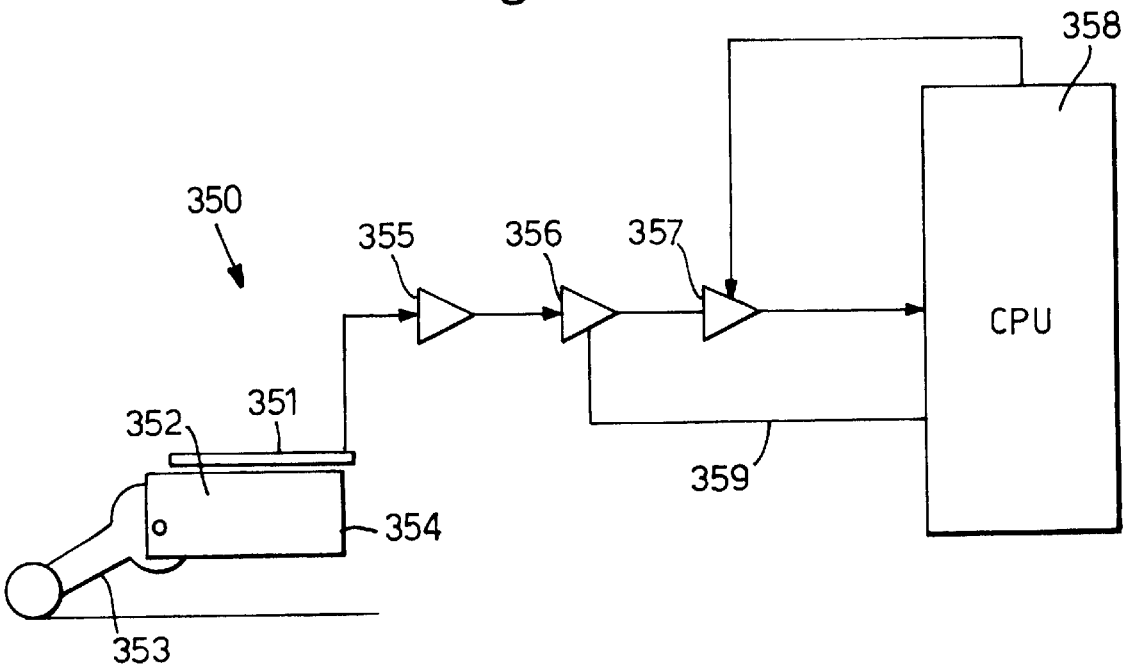
FIG. 3 is a block diagram of the control circuit.

The detector, FIG. 3, is a two-channel thickness measurement sensor assembly and comprises of a PCB assembly 351, including two sensor assemblies 352 positioned such that they are an equal distance on either side of the centreline of the note transport path, each sensor assembly 352 comprising of a lever arm 353, operating in a slotted optical switch 354.

In operation, a DC offset 359 from the CPU 358 is used to establish the zero (no note present) threshold. When a note passes under the lever, the lever position is changed according to the thickness of the note or notes passing through the multiple note detector and the output current from the PCB assembly 351 is also changed proportionally. A transducer 355 converts this current to voltage which is then amplified by amplifier 356 and amplified again in a programmable amplifier 357, having a gain 1–12, to produce a voltage swing of 1V per note.

If a single note is successfully detected, it is transported to an exit opening 450.

If more than one note is detected by the multiple note detector, a diverter guide 401 located in diverter area 400 (FIG. 1*b*) and positioned by a diverter motor 405 to divert single notes to the exit opening 450, is moved by deactivating the motor, to the position shown in FIG. 1*b* to guide the notes to a reject compartment 700. It will be noted that the reject compartment 700 is located within the same note box as contains the note compartment 100 thus leading to a compact construction.

Although the apparatus has been shown in connection with banknote dispensing, it is applicable to the feeding of other types of sheets but particularly security documents.

It will be readily appreciated by a person of ordinary skill in the art that this invention can be adapted to handle a wide range of currencies and media, quantities of currency and media, and a wide range of physical document sizes. It can also be easily modified from a single denomination dispenser to a multi-denomination dispenser.

We claim:

1. A document dispensing apparatus, comprising:

a document store having a document exit;

a feed roller for feeding documents out of the document store through the document exit;

a separation system including a pair of juxtaposed rollers defining a nip to which documents are fed from the document exit;

a drive motor coupled to one of the rollers to cause one roller to rotate in a document feed direction, the one roller being drivingly coupled to an other roller of the pair via a one-way transmission such that a drive is communicated to the other roller only when the one roller is driven in a direction opposite to the feed direction; and a shaft secured to the other roller, the shaft being secured to a housing via a first one-way clutch which prevents rotation of the shaft in the feed direction and a pulley connected to the shaft by a second one-way clutch so that drive an be communicated to the other roller.

2. The apparatus according to claim 1, wherein the coefficient of friction of the one roller is higher than that of the other roller.

3. The apparatus according to claim 1, wherein the juxtaposed rollers are mutually biased towards each other and are movable relative to one another in a direction transverse to the direction of movement of said document.

4. The apparatus according to claim 1, further comprising a pusher for urging documents in the document store towards the document exit.

5. A document dispensing apparatus, comprising:

a document store having a document exit;

a feed roller for feeding documents out of the document store through the document exit;

a separation system including a pair of juxtaposed rollers defining a nip to which documents are fed from the document exit;

a drive motor coupled to one of the rollers to cause one roller to rotate in a document feed direction, the one roller being drivingly coupled to an other roller of the pair via a one-way transmission such that a drive is communicated to the other roller only when the one roller is driven in a direction opposite to the feed direction;

a conveyor which receives the document passing between the pair of rollers, and which conveys the document at an elevated speed;

a sensor for detecting the presence of the document at an inlet to the conveyor; and a control unit, the sensor being adapted to cause the control unit to influence a current supply to the drive motor when detecting a leading edge of said document, so as to reduce braking of the document passing through the roller pair and having entered the conveyor, to a selected level.

6. The apparatus according to claim 5, wherein the sensor is adapted to cause the drive motor to be driven in a reverse direction for a selected period of time when said sensor detects the presence of the trailing edge of said document so that the other roller of the roller pair is driven for rotation via the one-way transmission.

7. The apparatus according to claim 6, wherein said time period is selected to give limited rotation to the other roller of said roller pair, so that a fresh peripheral part of the other roller will be exposed to the one roller in said roller part.

8. The apparatus according to claim 5, wherein the coefficient of friction of the one roller is higher than that of the other roller.

9. The apparatus according to claim 5, wherein the juxtaposed rollers are mutually biased towards each other and are movable relative to one another in a direction transverse to the direction of movement of said document.

10. The apparatus according to claim 5, further comprising a pusher for urging documents in the document store towards the document exit.

11. A document dispensing apparatus, comprising:

a document store having a document exit;

a feed roller for feeding documents out of the document store through the document exit;

a separation system including a pair of juxtaposed rollers defining a nip to which documents are fed from the document exit; and a drive motor coupled to one of the rollers to cause one roller to rotate in a document feed direction, the one roller being drivingly coupled to an other roller of the pair via a one-way transmission such that a drive is communicated to the other roller only when the one roller is driven in a direction opposite to the feed direction, wherein the one-way transmission includes a pair of mutually engaging gearwheels which are carried coaxially by the respective rollers in the roller pair, and the other roller of said roller pair carries its gearwheel via a freewheeling hub.

12. The apparatus according to claim 11, wherein the coefficient of friction of the one roller is higher than that of the other roller.

13. The apparatus according to claim 11, wherein the juxtaposed rollers are mutually biased towards each other and are movable relative to one another in a direction transverse to the direction of movement of said document.

14. The apparatus according to claim 11, further comprising a pusher for urging documents in the document store towards the document exit.

* * * * *